US005954215A

United States Patent [19]

Alter

[11] Patent Number: 5,954,215

[45] Date of Patent: Sep. 21, 1999

[54] LEAK-PROOF CONTAINER

[75] Inventor: Konrad G. Alter, Maylands, Australia

[73] Assignees: James A. Schwartz; Robert D. Marley, both of Clearwater, Fla.; John Clegg, Rossmoyne; Nujenko Pty. Ltd., Welshpool, both of Australia

[21] Appl. No.: 08/764,689

[22] Filed: Dec. 11, 1996

[51] Int. Cl.[6] ..... B65D 41/16

[52] U.S. Cl. ..... 215/318; 215/320; 215/354

[58] Field of Search ..... 215/318, 320, 215/354, 356

[56] References Cited

U.S. PATENT DOCUMENTS

| | | | |
|---|---|---|---|
| 1,615,157 | 1/1927 | Baum | 215/354 X |
| 3,186,573 | 6/1965 | Salminen | 215/354 X |
| 3,223,269 | 12/1965 | Williams | 215/354 X |
| 3,239,090 | 3/1966 | Bramming | 215/354 X |
| 3,572,413 | 3/1971 | Livingstone | 215/354 X |
| 3,991,895 | 11/1976 | Thornton | 215/211 |
| 4,845,038 | 7/1989 | Barr et al. | 215/354 X |
| 5,190,178 | 3/1993 | Luch | 215/256 |
| 5,385,253 | 1/1995 | Scharf et al. | 215/296 |
| 5,630,522 | 5/1997 | Montgomery | 215/344 |

*Primary Examiner*—Stephen K. Cronin
*Attorney, Agent, or Firm*—Ronald E. Smith

[57] ABSTRACT

A closure for a container having an open top surrounded by a container wall. The closure includes a top wall from which a hollow insert depends for reception within the opening of the container and further includes an outer skirt that depends from the top wall for releasably engaging an outer face of the container wall. The insert has a first seal and a second seal for sealingly engaging the inner face of the container wall. The second seal is formed upwardly of the first seal, and a channel is formed between the seals to prevent leakage through capillary action. Additional embodiments include a bulbous first seal, a reinforced closure for pressurization or vacuum applications, flat-bottomed external screw threads formed on the container to prevent a pulling force from separating the closure from the container, and an annular concavity formed in the closure to enable internal threads formed in the outer skirt to slip over the external threads formed in the container during attachment of the closure to the container by a pushing action.

18 Claims, 12 Drawing Sheets

LEAK-PROOF CONTAINER

BACKGROUND OF THE INVENTION

1. Field of the Invention

This invention relates to a leak-proof closure for a container, to a container fitted with such a closure, and to the combination thereof. More particularly, it relates to a container having a snap on, screw-off closure that is hermetically sealed against leakage.

2. Description of the Prior Art

Many containers and closures are especially designed to prevent leakage from the container. Non-leakage is of particular importance where biological specimens, such as urine specimens, are involved because leakage from one container can cross-contaminate the contents of another container and lead to mis-diagnoses and other unwanted outcomes. Urine specimen containers are particularly susceptible to cross-contamination because they are typically packed and transported in close proximity to one another and are easily tipped over or jostled. The contents of one container can easily mix with the contents of its contiguous containers if any leakage is present.

Snap-on, screw-off lids are known, but they are seldom used with biological specimen containers because they are susceptible to leakage. Moreover, since they are not hermetically sealed, they cannot be used in applications requiring the container to maintain a positive pressure or a vacuum. The conventional wisdom, therefore, is that screw-on, screw-off lids are best used in such applications.

Containers which are fitted with conventional screw caps perform satisfactorily as biological specimen containers provided that the screw caps are fitted correctly and that the thread formation is dry when the cap is screwed into position. If, however, the cap is cross-threaded or urine is present on the thread formation, leakage can occur. Leakage arising from the presence of urine on the thread formation occurs because of capillary action.

A number of leak-free screw-on lids have been developed, but the rotational-motion, automatic or robotic equipment required to screw the lids on is expensive.

There is a need, then, for a snap-on, screw-off lid that is free from leakage problems. Such a lid could be installed on containers in mass production lines by inexpensive, non-rotational, vertically-reciprocating automated equipment. Accordingly, it would benefit not only the biological specimen handling industry but the container and bottling industries in general as well. Still further benefits would accrue if such a container could be provided with hermetic sealing means.

What is needed, then, is a container and snap-on, screw-off closure design that prevents leakage of fluids even when the container is inverted or tipped over on its side. There is a need for such a container and closure design that maintains a vacuum or pressure as well.

However, at the time the present invention was made, it was not obvious to those of ordinary skill in this art how the needed structure could be provided.

SUMMARY OF THE INVENTION

The longstanding but heretofore unfulfilled need for a container having a leak-proof, vacuum or pressure-maintaining, snap-on, screw off closure is now met by a new, useful, and nonobvious closure and container combination. The container includes an imperforate bottom plate and a cylindrical side wall mounted about the periphery thereof.

The cylindrical side wall projects upwardly from said bottom plate and defines a cavity for the reception of fluids. In other words, the container includes a cylindrical opening surrounded by a container wall, said opening being closed on a first end by said bottom plate and being open at a second end thereof.

The novel closure includes an inner cylindrical wall or insert for sliding reception within the opening of the container and an outer skirt for releasably engaging the container wall, the insert having a first seal for sealingly engaging the inner face of the container wall, the insert extending longitudinally beyond the outer skirt and the first seal being located beyond the outer skirt. Both the insert and outer skirt depend from a top wall of the closure, in concentric relation to one another, with the insert being disposed radially inwardly of the outer skirt, said outer skirt depending from the outermost periphery of said top wall.

This arrangement is particularly advantageous in circumstances where the wall of the container is formed of translucent or transparent material for the reason that the integrity of the first seal is visible from the exterior of the container. The container wall may have a magnifying effect on said first seal thereby further assisting a visual inspection of the integrity of said seal.

A further advantage of this arrangement is that the insert assists in guiding the closure into a position on the container where the outer skirt can releasably engage the outer face of the container wall in an effective manner.

The first seal has an annular configuration and is formed at the free end of the insert. It is resiliently compressible inwardly in the radial direction to assist in sealing engagement with the inner face of the container wall. In this regard, said annular seal is advantageously formed of a plastic material and is of a construction which reduces in thickness towards the free end of the insert.

In a first embodiment, said annular first seal presents a convex surface for sealing engagement with the inner face of the container wall. In a second embodiment, the annular formation presents a concave surface which terminates at an annular sealing edge. In a third embodiment, the free end of the annular seal is bulbous, i.e., has a radius, and sealingly abuts a diameter-reducing bevel formed in the inner face of the container wall.

A second annular seal, also for sealingly engaging the inner face of the container wall, is positioned between the first seal and the top wall of the closure. An annular, concave channel is defined between the two seals.

Preferably, the annular channel is at least partly disposed longitudinally beyond the lowermost or free end of the outer skirt. In this way, at least part of the channel is visible from the exterior of the container in circumstances where the container wall is formed of translucent or transparent material. This allows visual inspection of the channel for the presence of liquid, which preence would provide an indication of leakage. The container wall may have a magnifying effect to facilitate said visual inspection of the seal. Such magnifying effect may be provided by, or enhanced by, a magnifying means provided on the outer face of the container wall. The magnifying means may comprise a magnifying formation such as a circumferential bead formed on said outer face.

The second seal is in the form of an annular sealing edge. In one embodiment, the annular sealing edge may comprise a rib defined by two converging, radially outwardly extending walls. In another embodiment, the annular sealing edge may be defined by the junction between the edge of the circumferential channel and the section of the insert adjacent thereto.

The insert and outer skirt of the closure are positioned in concentric, radially spaced apart relationship to one another to define a gap therebetween into which the free end or rim of the container wall is received when the closure is fitted onto the container. The fitting of said rim into said gap constitutes an additional sealing means between the novel container and closure.

More particularly, the gap is beveled at its uppermost end to sealingly engage the inner and outer edges of the rim.

Preferably, the outer skirt of the closure is releasably engagable with the wall of the container by way of a thread formation. The thread formation may comprise a male thread, and a complementary female thread which comprises a plurality of spaced apart thread sections, each of which is flexible. The flexible female thread sections permit engagement between the closure and the container in one of two ways, either by screwing the closure onto the container or by pushing the closure onto the container to cause the outer skirt, within which the female thread sections are formed, to flex so that the female threads ride over the male thread for engagement by a snap action. In either case, once the male and female threads are engaged, they can only be disengaged by an unscrewing action. In this regard, the profile of the male thread is such that it allows the female thread sections to ride over it as the closure is pushed onto the container but resists the female thread sections riding over it in the reverse direction for disengagement.

The body of the closure includes a cap having a top wall and a side wall, the side wall depending from the periphery of the top wall and defining the outer skirt. The aforementioned insert also depends from the top wall, radially inwardly of the outer skirt in concentric relation thereto. The insert is of hollow cylindrical formation. Preferably, the cap is of one-piece construction and is formed of a plastic material.

The first of the multiple seals provided by the novel structure is provided in the form of an annular formation on the free end of the insert. The annular formation is resiliently compressible inwardly in the radial direction. To accomplish this, the annular formation may be of a construction which reduces in thickness in the direction towards the free end of the insert and may be formed of a plastic material which facilitates the resilient compression.

The invention still further provides a closure for a container having an opening surrounded by a container wall, the closure including an insert for reception within the opening of the container and an outer skirt for engaging the container wall, the insert being resiliently compressible inwardly in the radial direction at its free end and having a seal on the resiliently compressible end for sealingly engaging the inner face of the container wall, the arrangement being such that the seal sealingly engages the inner face of the container wall prior to the outer skirt fully engaging the outer face of the container wall.

An annular bevel is formed in the inner face of the container wall so that the upper part of the container has an interior diameter greater than the lower part of the container. The annular bevel is adapted to cooperate with the seal on the insert of the closure to effect radial compression of the seal as the insert progressively enters the opening. The annular bevel may also take a form which does not change the interior diameter of the container.

The invention accordingly comprises the features of construction, arrangement of parts, and combination of elements as set forth herein, and the scope of the invention will be indicated in the claims.

BRIEF DESCRIPTION OF THE DRAWINGS

For a fuller understanding of the invention, reference should be made to the following detailed description, taken in connection with the accompanying drawings in which.

DETAILED DESCRIPTION OF THE PREFERRED EMBODIMENT

Figure 1:
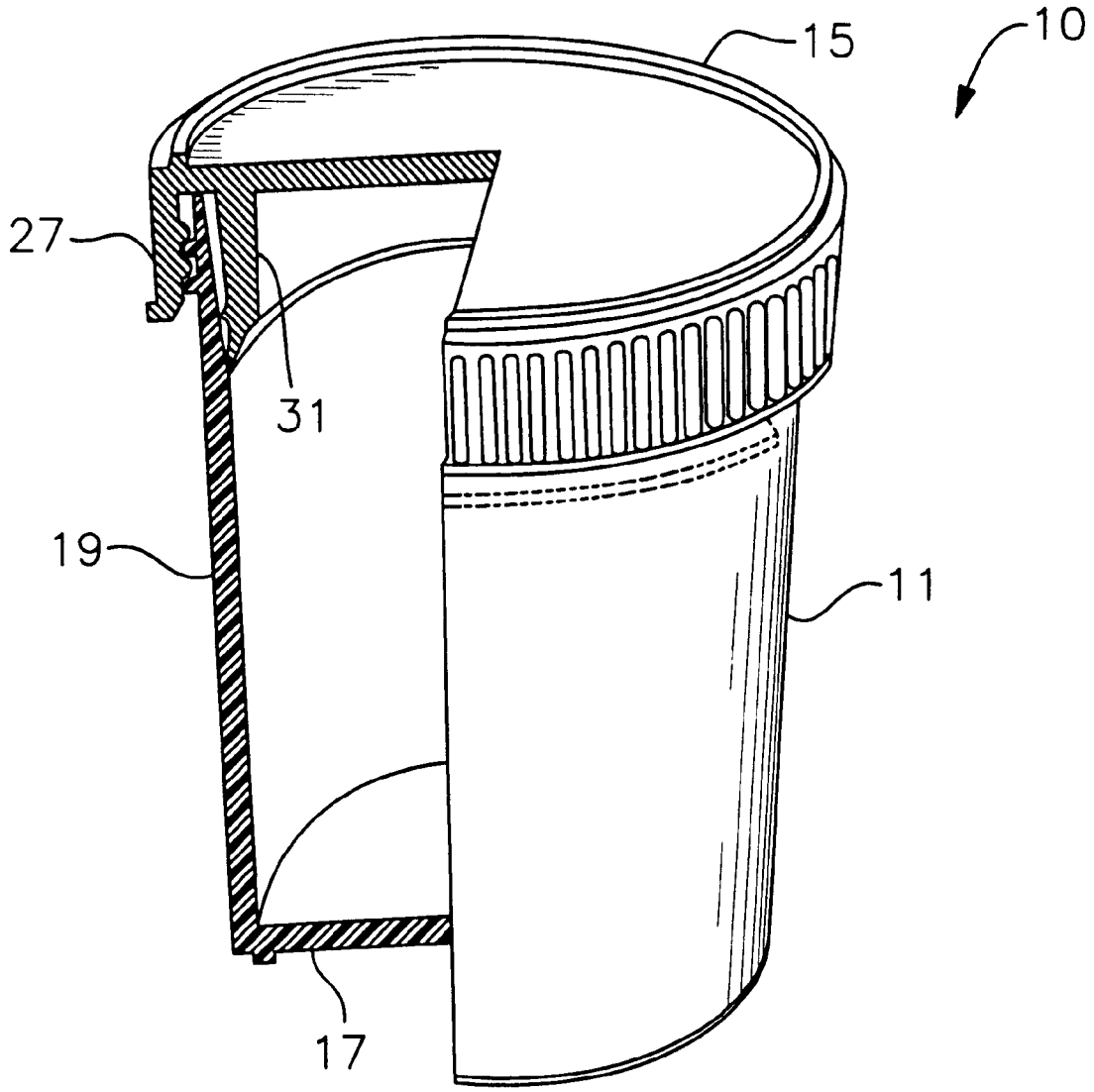
FIG. 1 This a perspective view of a container and closure of the first embodiment with a section thereof cut away.
Figure 2:
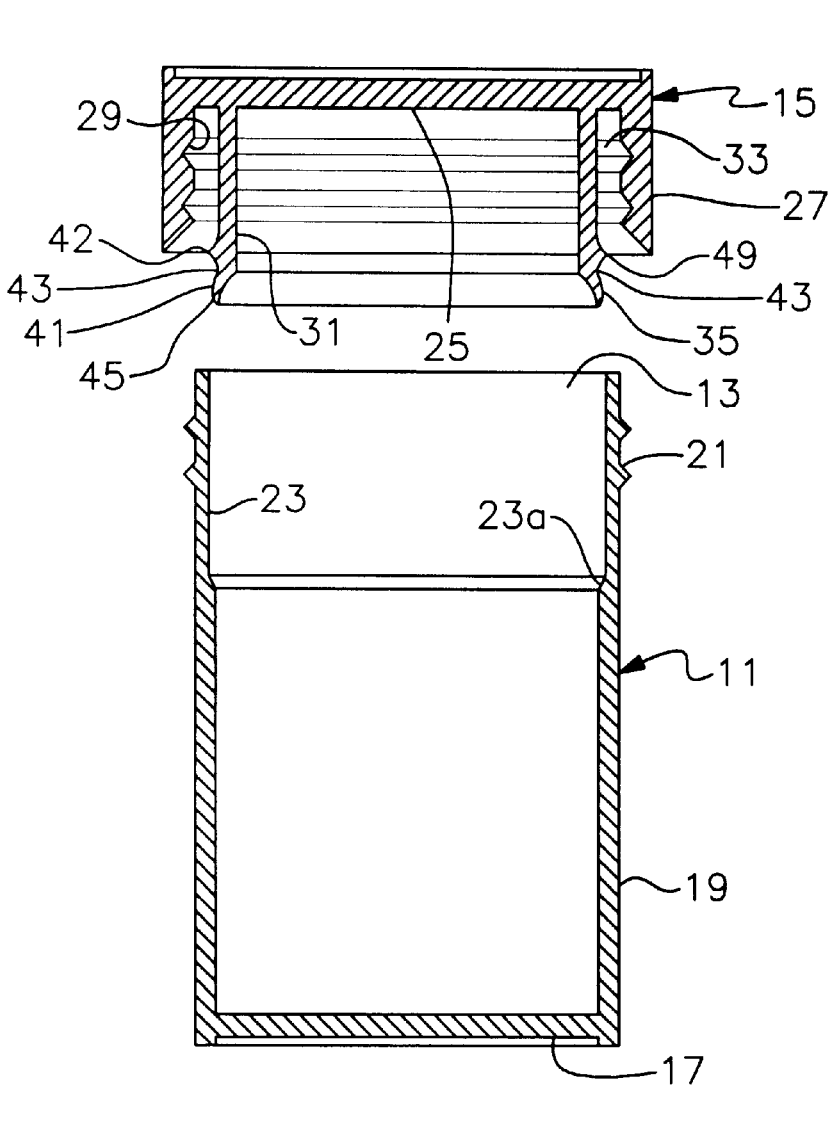
FIG. 2 is a schematic sectional elevation of the container and closure.
Figure 3:
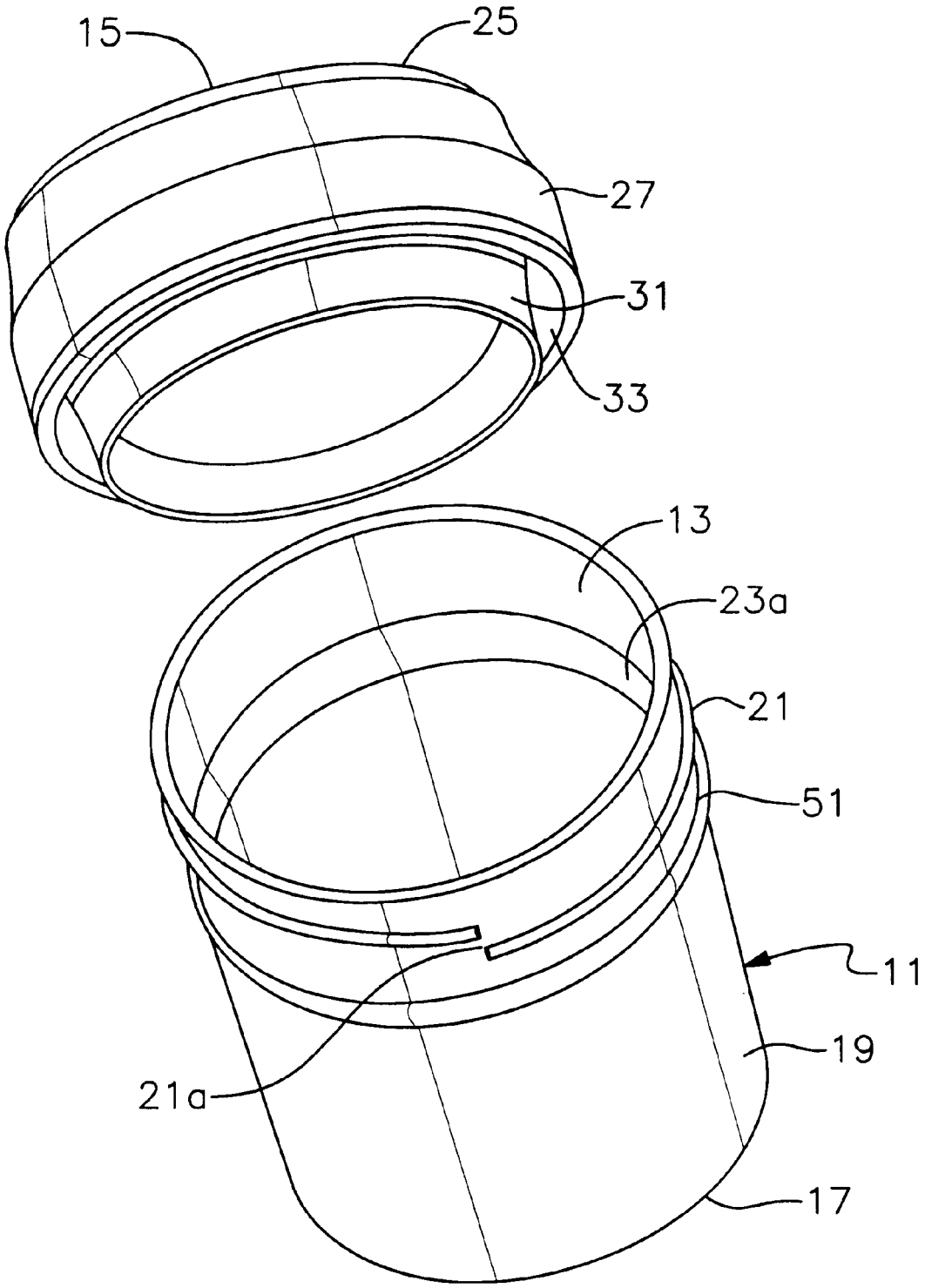
FIG. 3 is an exploded perspective view of a container and closure according to a second embodiment.

Referring now to FIGS. 1 and 2, it will there be seen that the novel closure and container are collectively denoted 10 as a whole.

Container 11 has an open top 13, and closure 15 selectively closes said open top.

Container 11 includes bottom wall 17 and cylindrical side wall 19 which surrounds the open top 13. Bottom wall 17 and container wall 19 are preferably formed of a clear plastic material so that the contents of the container are readily visible. However, containers made of different materials, whether opaque, translucent, or transparent, such as glass, metal, or other suitable compositions, are within the scope of this invention.

As indicated in FIG. 2, an external thread formation 21 is provided on the outer face of container wall 19 in the vicinity of the open top 13.

Container wall 19 includes an upper section 23 (FIG. 2) having less thickness than the lower part of said wall 19; an annular bevel 23*a* is formed in said container wall to divide said wall into its lower and upper sections as best understood in connection with FIG. 2. As a result, the upper part of container 11 has an interior diameter greater than the interior diameter of the lower part. However, a container having a cylindrical wall of uniform thickness is also within the scope of this invention. More particularly, an annular bead could be added to the interior face of container wall 19; the bead would perform the same function as annular bevel 23*a* and would not require any change in container wall thickness.

Closure 15 is in the form of a cap of one-piece construction formed, preferably, from a plastic material. The cap includes a top wall 25 and a cylindrical side wall or outer skirt 27 depending from the outer periphery of said top wall 25. The inner face of outer skirt 27 is provided with an internal female thread formation 29 for engaging the external thread formation 21 on the outer face of container wall 19.

The top wall 25 depicted in this embodiment is employed in those applications where the contents of container 11 are neither pressurized nor under a vaccuum.

Cap 15 further includes insert 31 of hollow cylindrical formation for reception within the container through the open top 13. Insert 31 depends from closure top wall 25, radially inwardly of outer skirt 27; annular gap 33 is formed by said spacing.

Insert 31 is adapted to sealingly engage the inner face of container wall 19. More specifically, said insert is adapted to sealingly engage upper end 23 of container wall 19.

Insert 31 extends longitudinally beyond outer skirt 27 and has a sealing means 35 at its free end for effecting sealing engagement with the inner face of upper container wall 23.

Sealing means 35 includes a first annular seal 41 and a second annular seal 42 (FIG. 2). First and second seals 41 and 42 are disposed in longitudinally spaced relationship to one another to define annular channel 43 therebetween, said channel being formed on the outer face of insert 31 so that it confronts the inner face of container wall 19 when the cap is fitted onto the container.

First seal 41 is positioned at the free end of insert 31 and channel 43 is positioned so that it is not obscured by outer skirt 27 when cap 15 is fitted onto container 11. In this way, channel 43 can be inspected through the transparent container wall 19 when said cap is fitted to said container.

First seal 41 comprises an annular formation of a construction which tapers downwardly in thickness in the direction towards the free end of insert 31, as best depicted in FIG. 2 of the drawings. Seal 41 includes a convex face 45 for sealing contact with the inner face of container upper wall 23.

Annular formation 41 undergoes resilient compression in the radially inward direction to facilitate a positive seal with the inner face of container upper wall 23. Such compression is a function of the plastic construction of said annular formation 41 and of the tapering thickness of said annular formation.

Second seal 42 includes two radially outwardly extending lateral walls which converge to form an annular sealing edge 49.

Sealing means 35 thus engages the inner face of upper container wall 23 prior to threaded engagement of cap 15 with container 11.

As insert 31 progressively enters opening 13 of the container, sealing means 35 is progressively compressed radially inwardly by the action of upper container wall 23, thereby ensuring a positive seal between said sealing means and said upper container wall. This action also serves to wipe the surface of upper container wall 23 to remove any liquid which may be present on the surface thereof.

As cap 15 is pushed onto container 11, contact occurs between the internal thread formation 29 on the inner face of outer skirt 27 and the external thread formation 21 on the outer face of upper container wall 23. At this point, cap 15 can continue to be pushed onto container 11 so that the threads "click" into engagement, i.e., the cap is pushed onto the container to effect engagement between the internal and external thread formations. Alternatively, if desired, the cap can be screw threaded onto the container.

A benefit of the arrangement according to this embodiment is that sealing between the cap and the container is effected by cooperation between the insert 31 and the inner surface of upper container wall 23. As a consequence of this, no leakage occurs if the cap is not fitted tightly onto the container. The existence of sealing insert 31 also serves to guide the cap into its position on the container for threaded engagement; such guidance has utility for either machine or manual attachment of the closure to the container.

Because the side wall 19 of the container is transparent, the seal provided by sealing means 35 can be inspected visually at any time. The transparent nature of container wall 19 has a magnifying effect which assists in the visual inspection of the seal. If leakage occurs, liquid will be present in channel 43 and this will provide an indication of a potential problem. It is, however, most unlikely that liquid could leak, spill, or drip from the container due to the presence of seals 41 and 42.

The second embodiment of the invention is depicted in FIGS. 3 to 8.

The second embodiment provides additional seals to enhance sealing contact between container 11 and closure 15. The additional seals are achieved by the uppermost end of gap 33 being specifically configured to sealingly engage the inner and outer edges of the uppermost end or rim of container wall 23 at locations 19*a* and 19*b* respectively (see FIG. 7). The gap is so configured by providing tapered surfaces 34 (FIG. 5) in flanking relation to said uppermost end thereof for sealingly engaging said rim in the manner shown in FIG. 8.

This arrangement provides four sealing contacts between container 11 and closure 15, namely, sealing provided by seals 41 and 42, and the seals provided at locations 19*a* and 19*b*.

Figure 8:
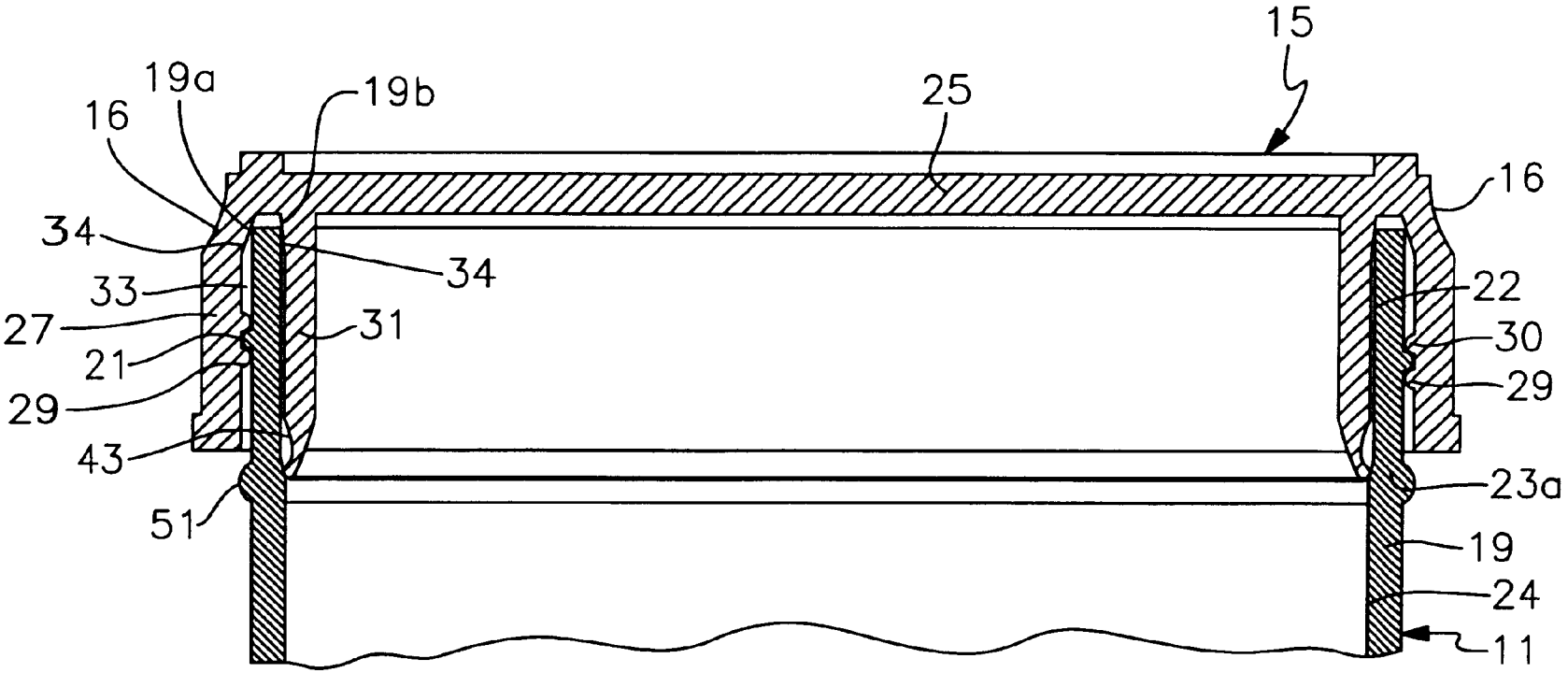
FIG. 8 is a fragmentary sectional elevational view of the second embodiment showing the closure fitted onto the container.

In this embodiment, annular bevel 23*a* is located longitudinally downwardly from open top 13 of container 11 so that the container has a first internal diameter at 22 on one side of bevel 23*a* and a second internal diameter at 24 on the other side thereof; as depicted in FIG. 8, first internal diameter 22 is greater than second internal diameter 24.

With respect to seals 41 and 42, note in FIG. 8 that first seal 41 engages the inner face of container wall 19 just downwardly of annular bevel 23*a* and seal 42 engages the inner face of upper container wall 23 just upwardly of said annular bevel.

First seal 41 is formed at the free end of insert 31 by a tapered formation 44 (FIG. 5) thereon which presents a concave face to container wall 19 (as distinguished from convex face 45 in the first embodiment) with the result that there is an annular sealing edge at the tip of said first seal. The concave face presented by tapered formation 44 provides annular channel 43.

Second seal 42 is defined by an annular sealing edge presented at the junction between the inner edge of annular channel 43 and section 46 of insert 31 adjacent thereto.

Figure 4:
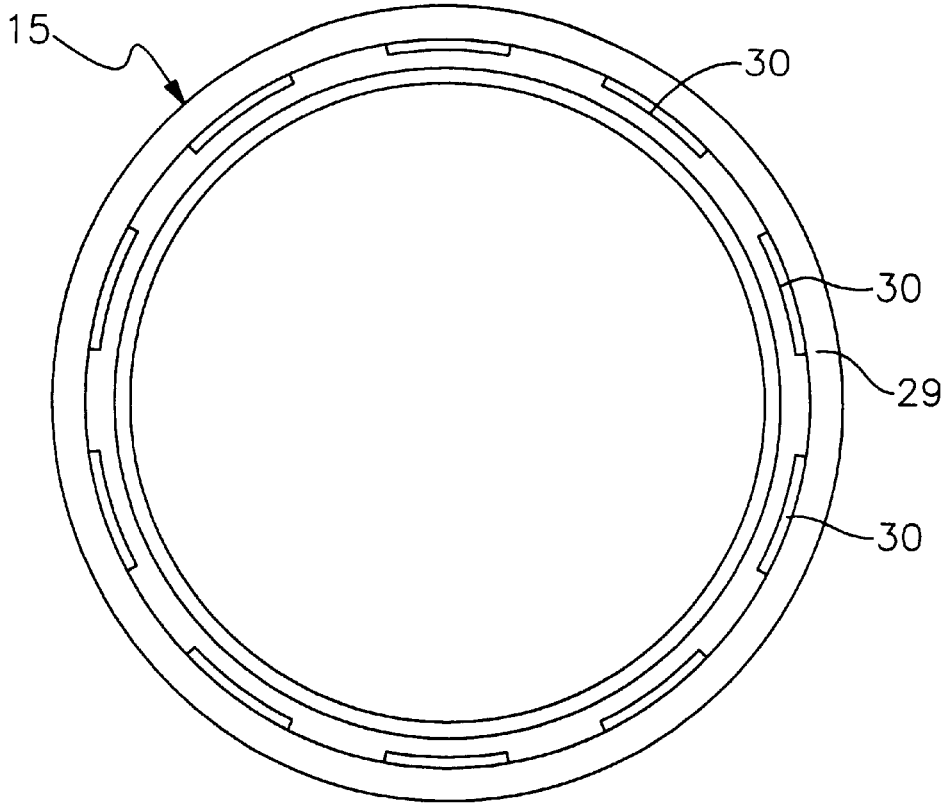
FIG. 4 is an underside plan view of the closure forming part of the second embodiment.
Figure 5:
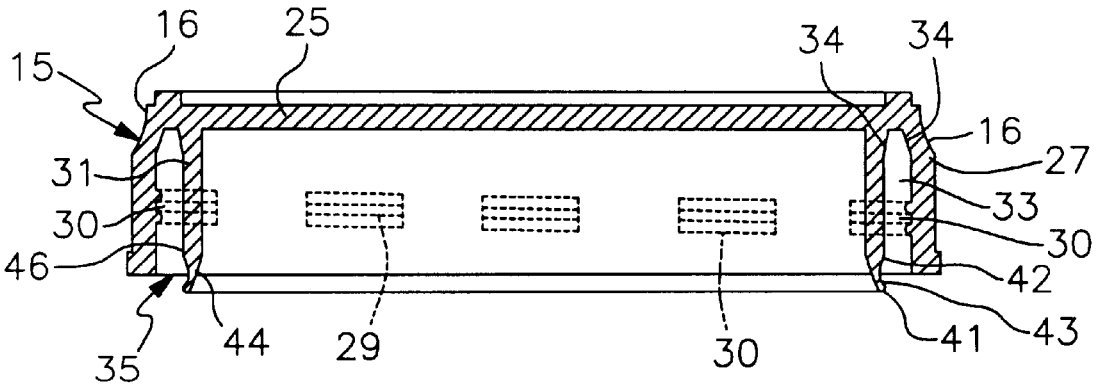
FIG. 5 is a sectional elevational view of the closure of FIG. 4.
Figure 6:
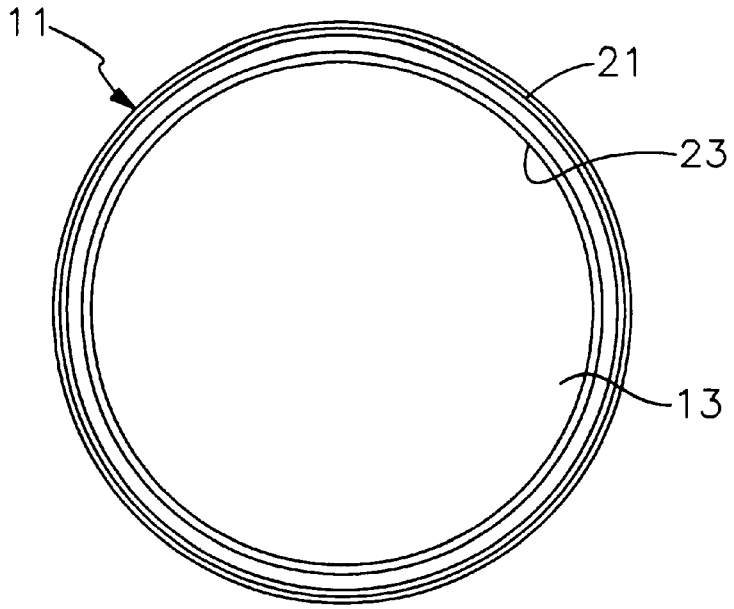
FIG. 6 is a plan view of the container forming part of the second embodiment.
Figure 7:
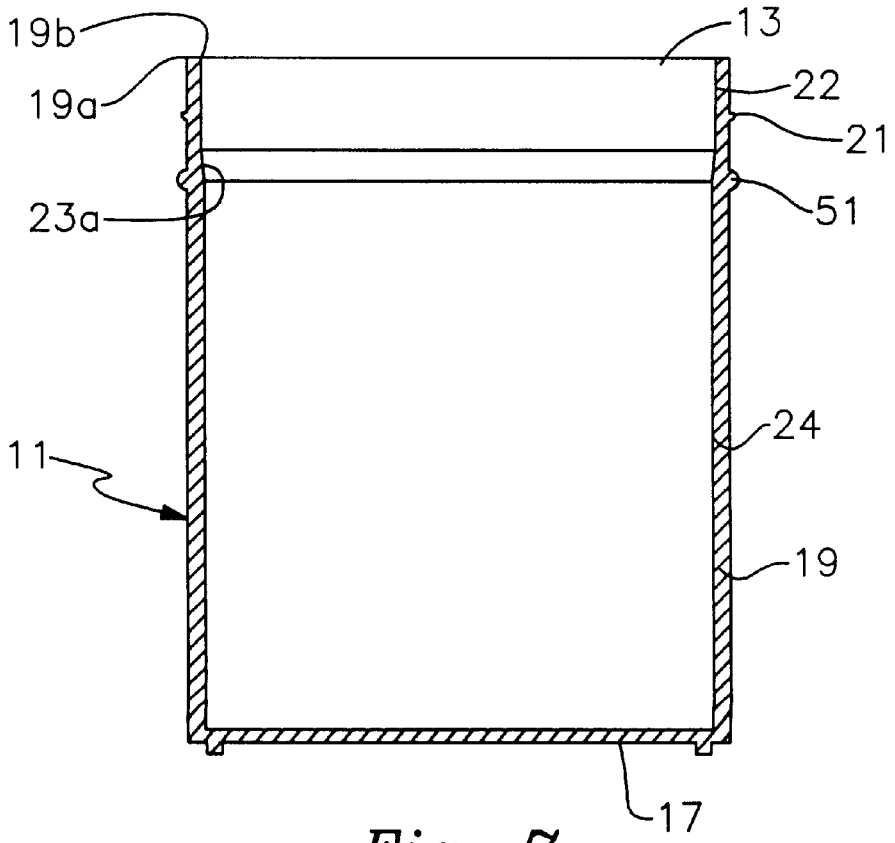
FIG. 7 is a sectional elevational view of the container of FIG. 6.

A further difference of the second embodiment relative to the first embodiment is the nature of the thread connection between container 11 and closure 15. In the second embodiment, male screw thread 21 comprises a two-start single thread, the starting locations 21*a* (FIG. 3) being diametrically opposed to one another, only one of said starting locations being visible in said FIG. 3. Each thread extends 180°. Female screw thread 29 is discontinuous, i.e., it is collectively defined by a plurality of equidistantly and circumferentially spaced, truncate thread sections 30, as best depicted in FIGS. 4 and 5. Female thread sections 30 are formed in outer skirt 27 which is slightly flexible due to the resilience of the material from which closure 15 is formed. The flexible nature of outer skirt 27 together with the profile of male thread 21 permits engagement between the closure and the container in one of two ways, either by screwing closure 15 onto container 11 or by pushing the closure onto the container to cause the outer skirt carrying the female thread sections 30 to transiently flex so that said female thread sections ride over, i.e., slip over, male thread 21 for engagement by a snap action. As previously mentioned, the profile of the male thread is such as to permit engagement with the snap action. The profile is, however, such that the closure can only be removed from the container by unscrewing the thread formation. Advantageously, the flexible but resilient construction of outer skirt 27 enables said outer skirt to serve as a bias means that urges female screw threads 30 radially inwardly when they are displaced radially outwardly from their collective positions of repose so that they snap back into engagement with the male screw threads as soon as they slip thereover.

Significantly, as mentioned earlier, each male thread 21 extends 180° around container 11 and said threads do not overlap one another, i.e., they are diametrically opposed to one another. Thus, the threading action can start in virtually any rotational position of the closure relative to the container.

A second embodiment of closure 15 is also depicted in FIGS. 5 and 8; note annular concavity 16 that circumscribes closure 15 just below its top wall. Annular concavity 16 increases the ability of outer skirt 27 to flex radially outwardly momentarily when the female screw threads ride over the male screw threads as discussed above, relative to the closure structure depicted in FIG. 2.

In the first embodiment, the seal provided by sealing means 35 was magnified by the transparent nature of container wall 19. Such magnification is enhanced in the present embodiment by the provision of a magnifying means 51 (FIG. 8) on the outer face of said container wall 19. Magnifying means 51 is provided in the form of a circumferential bead 51 that is formed integrally with said container wall 19.

Figure 9:
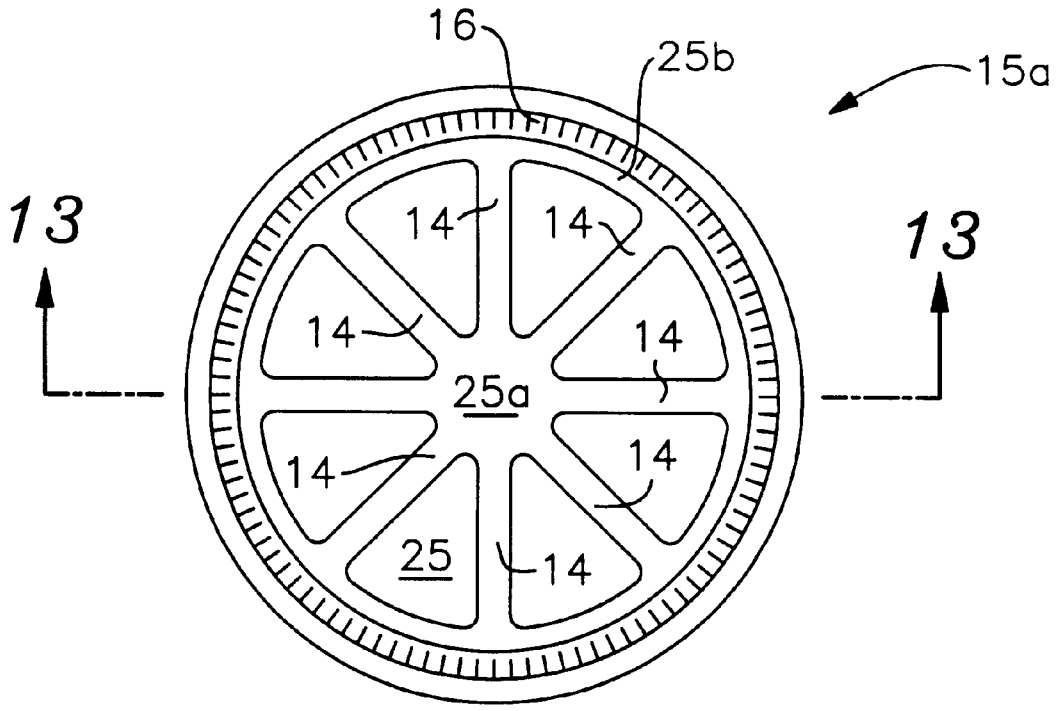
FIG. 9 is a top plan view of an alternative embodiment of the novel closure.
Figure 10:
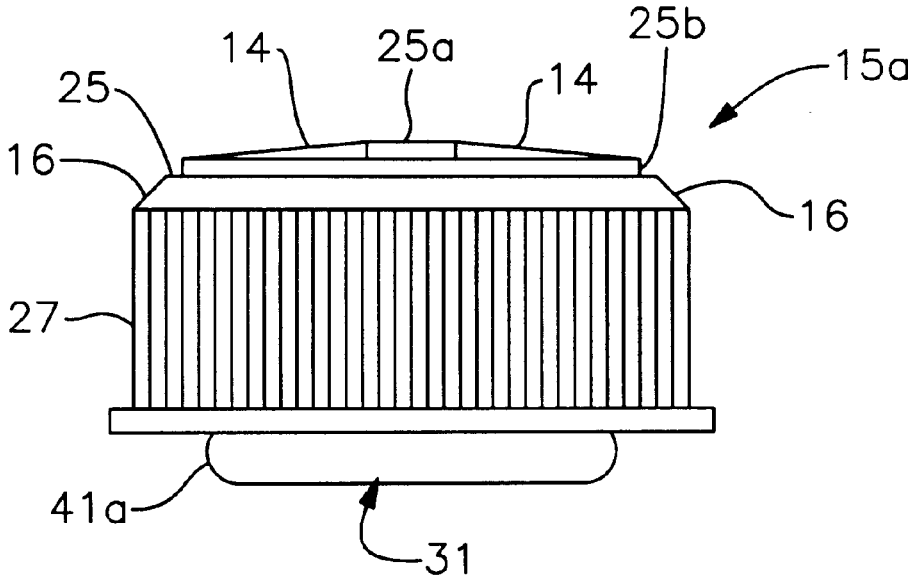
FIG. 10 is a side elevational view of said novel closure.

FIGS. 9 and 10 depict an improved closure 15*a*. More particularly, said improved closure has a plurality if radially disposed reinforcement or strengthening ribs, collectively denoted 14, formed therein. This closure 15*a* is employed in applications where the contents of container 11 are under positive pressure, i.e., where the contents are a carbonated soft drink or the like. Improved closure 15*a* is also used when it is desired to maintain a vaccuum within the container so that the contents thereof may be maintained in a fresh condition, e.g., where the contents are medicines, coffee grinds, and the like. The highest point of each rib 14 is at the center 25*a* of top wall 25 of closure 15 as best understood in connection with FIG. 10. The ribs gradually decrease in height in a radially outward direction until they are substantially flush with an annular ridge 25*b* that surmounts top wall 25 near the outer periphery of said top wall. Ribs 14 inhibit shrinking or contraction of closure 15*a* when it is subjected to temperature or pressure changes so that the hermetic seal provided by the novel construction is not lost.

Figure 11:
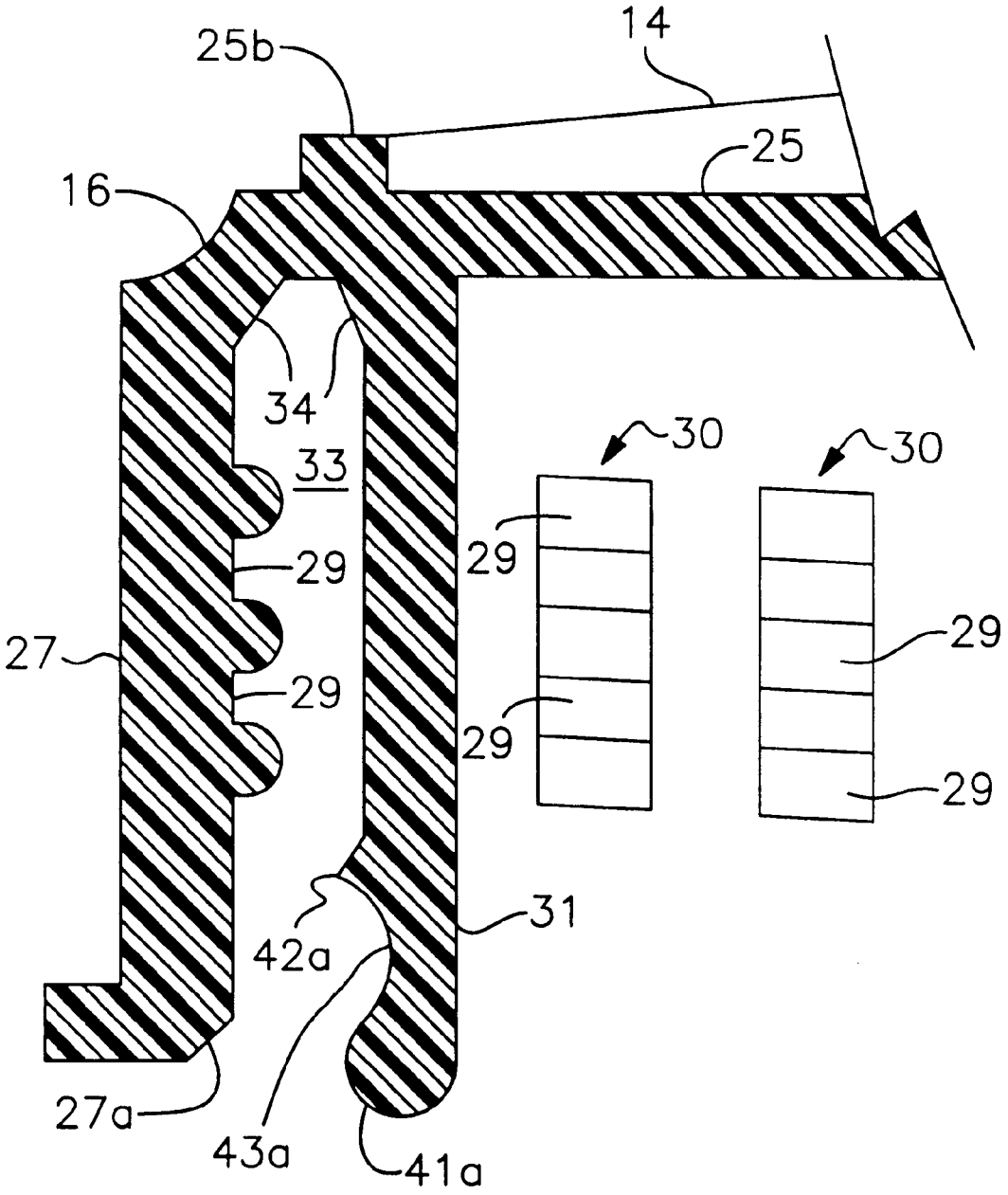
FIG. 11 is an enlarged sectional view of said novel closure.

FIG. 11 depicts an improved version of the novel sealing means. In this improved embodiment, annular sealing edge 42*a* is positioned longitudinally upwardly of its FIG. 2 counterpart. Note in FIG. 2 that annular sealing edge 42 is positioned substantially coplanar with the lowermost free end of outer skirt 27; in FIG. 11, annular sealing edge 42*a* is positioned upwardly of said lowermost free end, i.e., it is positioned within gap 33. Consequently, channel 43*a* is positioned in the FIG. 11 embodiment so that its midpoint or bight is positioned only slighly above said lowermost free end of outer skirt 27; in its FIG. 2 embodiment, said concavity 43 is positioned entirely downwardly of said lowermost free end.

First seal 41*a* in this embodiment is bulbous as depicted in FIG. 11 and is not tapered down to a sealing edge as depicted in FIG. 2. Annular bulbosity 41*a* fits against beveled surface 23*a* (see FIG. 12) and as such is in juxtaposition with magnifying means 51 formed on container wall 19. Thus, annular concavity 43*a* is positioned upwardly of annular bevel 23*a*; note that in the FIG. 8 embodiment, annular concavity 43 is in juxtaposition with annular bevel 23.

All of the sealing means disclosed herein are effective in part because they eliminate capillary action. Specifically, channel 43 or 43*a* provides an annular wide space that defeats capillary action in all embodiments herein.

Figure 12:
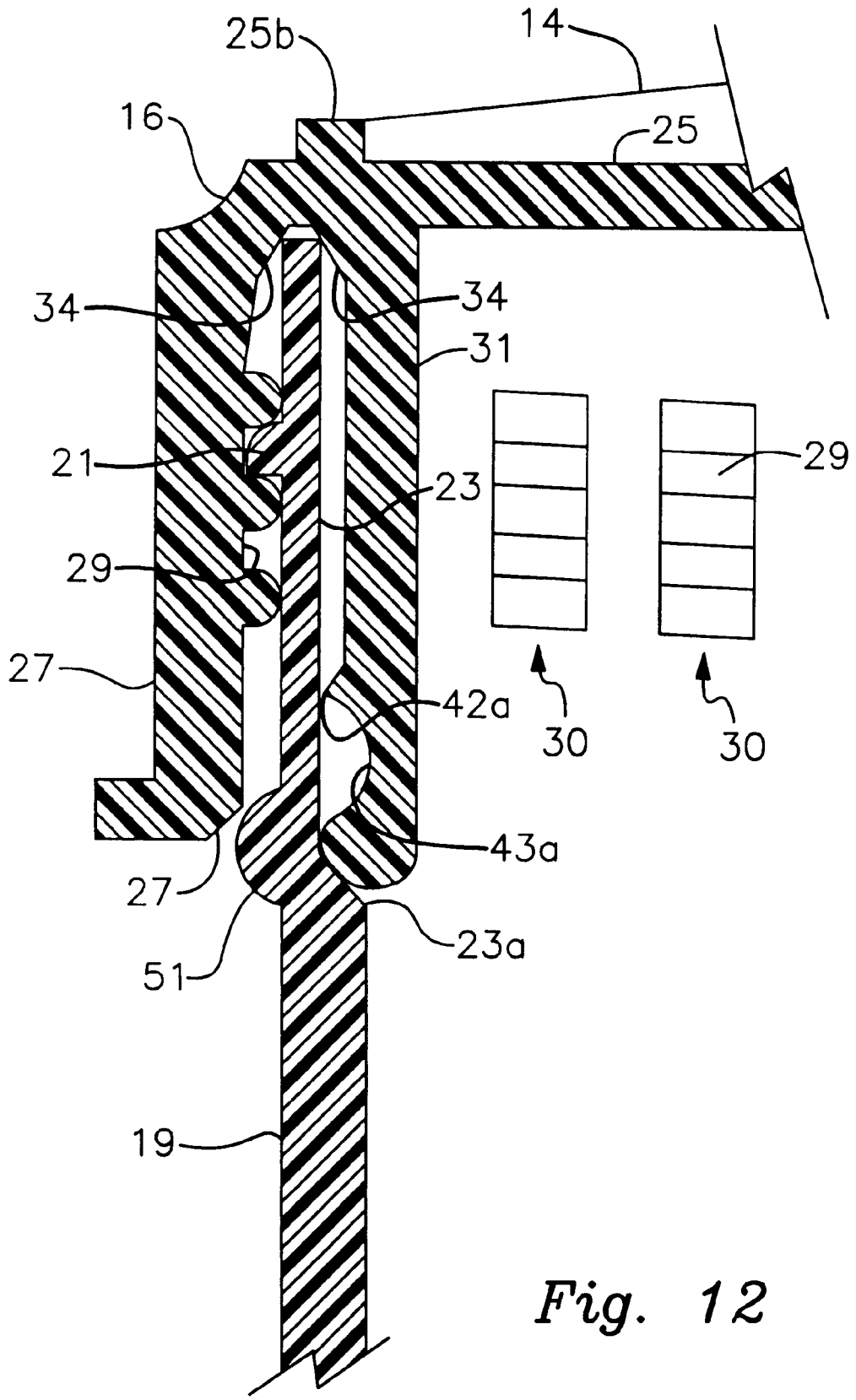
FIG. 12 is an enlarged sectional view of the novel closure, as in FIG. 11, and further depicting the uppermost free end of the container wall inserted into the gap between the outer skirt of the closure and the insert of the closure.
Figure 14:
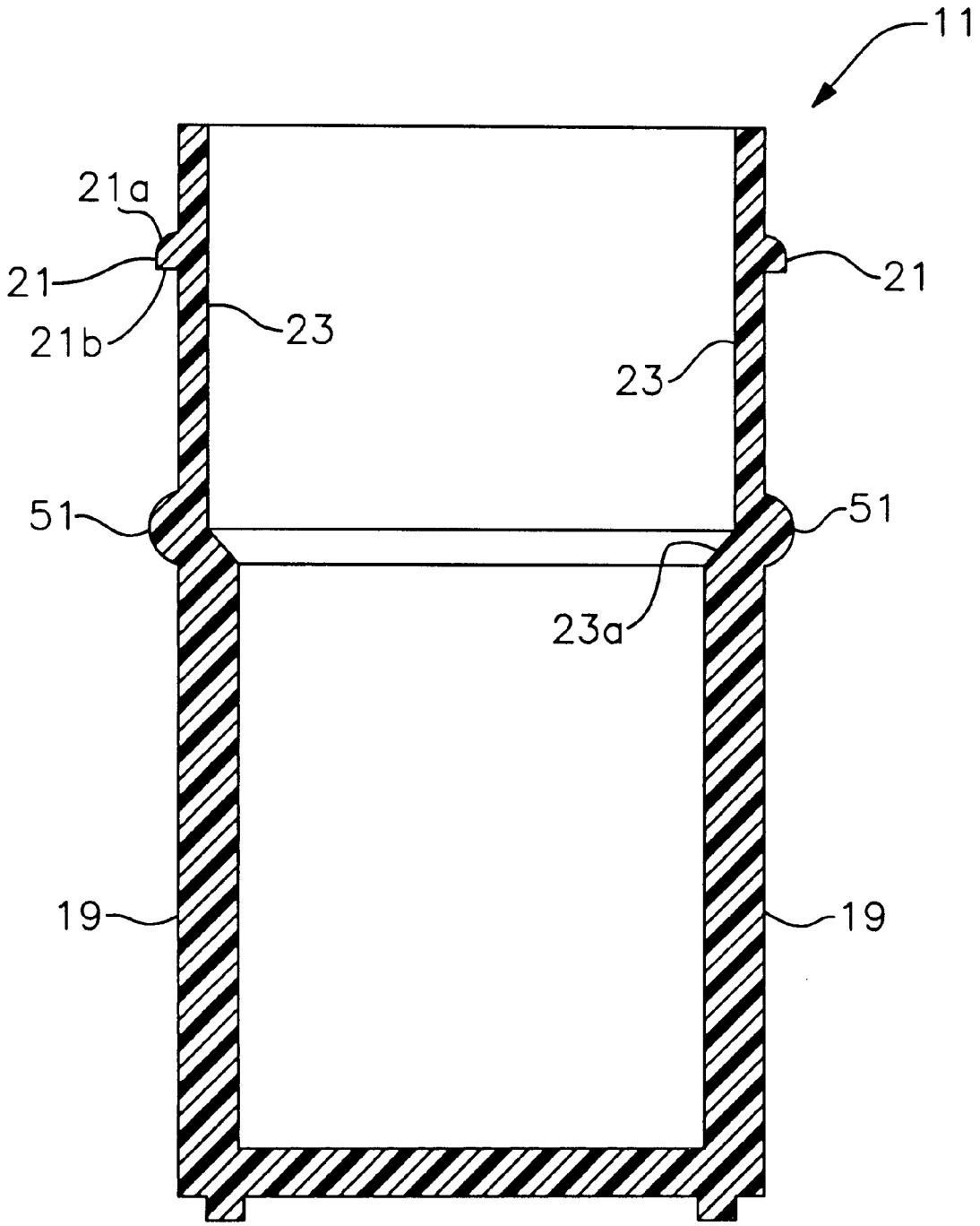
FIG. 14 is a detailed sectional view of the novel container wall, depicting a unique external thread profile.

FIGS. 12 and 14 illustrate the earlier-mentioned male thread that permits snap-on (push-on) attachment while defeating snap-off (pull-off) detachment. External thread 21 has a rounded upper surface 21*a* to facilitate sliding over thereof by discontinuous female threads 30 as closure 15 is snapped into fitting relation to container 11, but further has a flat lower surface 21*b* that traps the female threads thereunder to prevent reversal of the snap-on action, i.e., to permit separation of said closure and container only by a rotational, unscrewing motion.

Figure 13:
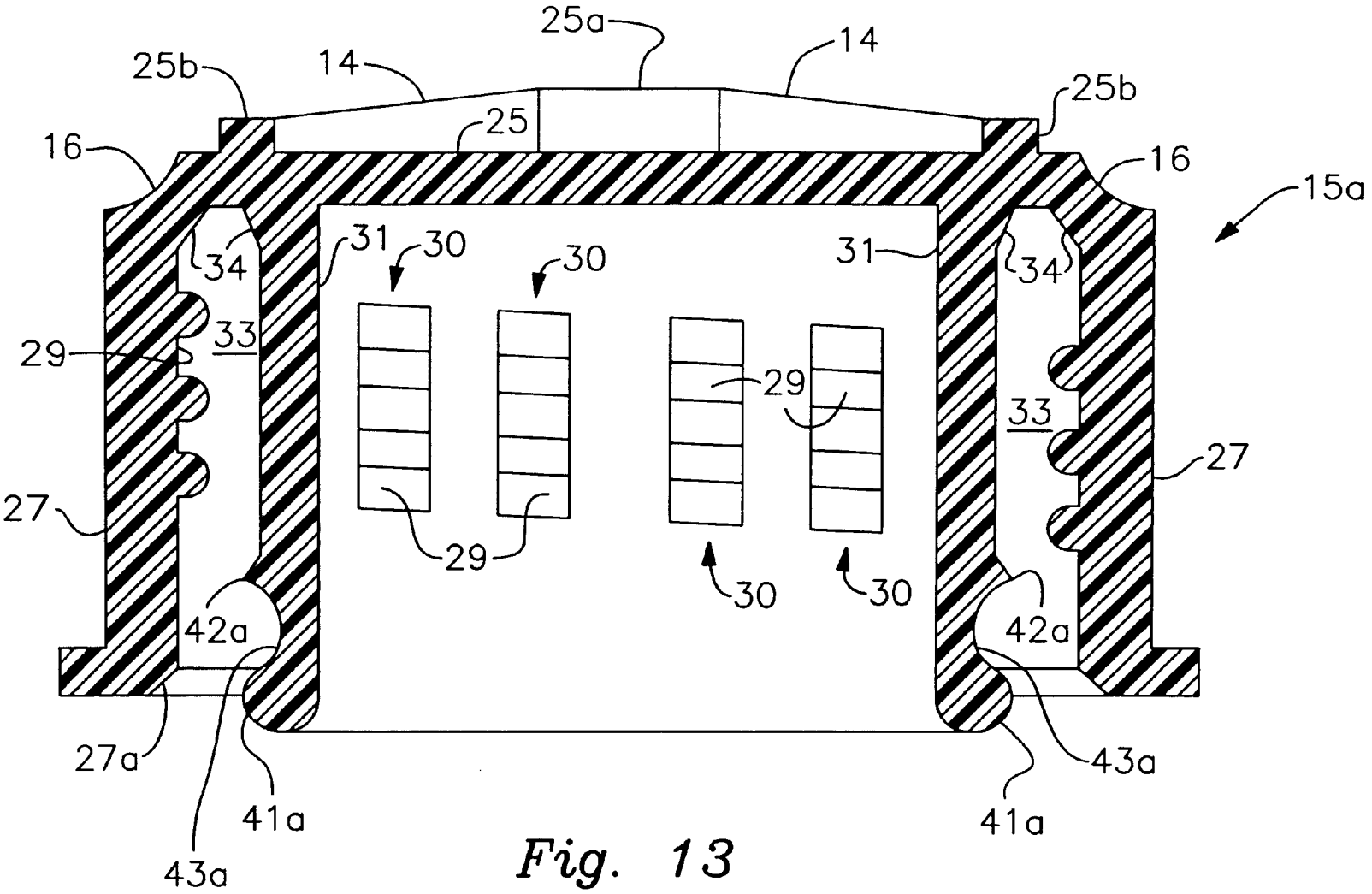
FIG. 13 is a sectional view taken along line 13—13 in FIG. 9.

FIGS. 11–13 also illustrate an annular bevel 27*a* that is formed in the lowermost free end of outer skirt 27 to accommodate magnifying bead 51.

Figure 15:
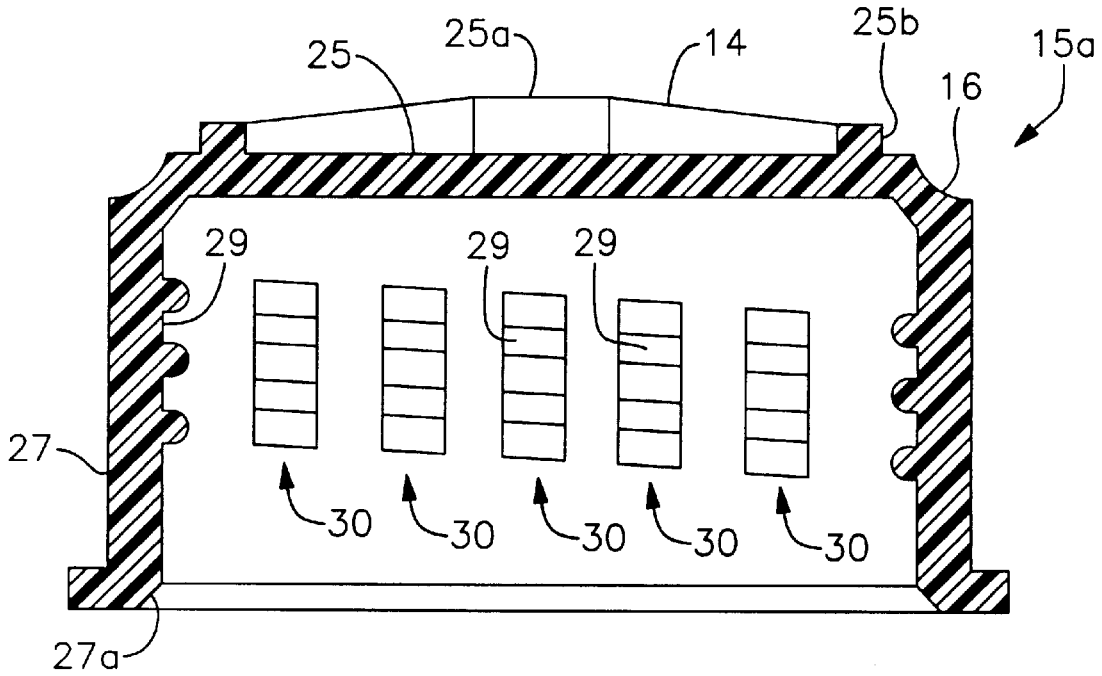
FIG. 15 depicts an embodiment having no insert.

The embodiment of FIG. 15 has no insert 31. This embodiment has utility in connection with containers having a seal or web attached (typically by heat-sealing) across the opening thereof to both seal the contents of the container and to indicate whether or not tampering with the contents thereof may have occured. Insert 31 cannot be used in connection with sealed containers of such type.

From the foregoing it is evident that the present invention provides a closure which hermetically engages a container to prevent leakage therefrom even in circumstances where the cap is not tightly threaded onto the container. The hermetic seal provided by the multiple sealing means enables the container to maintain a positive or negative pressure, thereby greatly increasing its utility, i.e., enabling its use in numerous applications.

It should be appreciated that the scope of the invention is not limited to the scope of the embodiments described.

In particular, it should be understood that the invention may have applications to various forms of containers and is not limited to containers for urine samples. Nor are the containers to which this invention has application limited in size, i.e., they may range in size from small containers of just one ounce capacity up to five gallon containers and even fifty gallon drums.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A closure for a container, said container having an opening surrounded by a container wall having an inner face and an outer face, the closure comprising:

a top wall;

an insert depending from said top wall, said insert adapted for sliding reception within said opening of said container;

an outer skirt depending from a peripheral edge of said top wall, said outer skirt being disposed concentrically with said insert, radially outwardly thereof;

said insert having a first annular seal for sealingly engaging the inner face of said container wall;
said first seal being bulbous-in-configuration;

said insert extending longitudinally beyond said outer skirt;

said first seal being positioned longitudinally beyond said outer skirt;

said first seal being formed in a free end of said insert and being resiliently compressible radially inwardly to facilitate its sealing engagement with said inner face of said container wall;

said first seal including a convex surface for sealing engagement with said inner face of said container wall;

said insert including a second seal for sealingly engaging said inner face of said container wall, said second seal being positioned between said first seal and said top wall;

an annular channel formed in said insert between said first and second seals; and said second seal including an annular sealing edge defined by two converging, radially outwardly extending walls.

2. A closure according to claim 1, wherein an annular bevel is formed on said inner face of said container wall so that an inside diameter of said container above said bevel is greater than an inside diameter of said container below said bevel, and wherein said bulbous first seal abuts said bevel.

3. A closure according to claim 1, further comprising a gap between said insert and said outer skirt, said gap adapted to receive a free end of said container wall when said closure is fitted to said container, said uppermost end of said gap including beveled walls that abuttingly engage free ends of said inner and outer faces of said container wall to further enhance sealing engagement between said closure and said container.

4. A closure according to claim 1, further comprising external screw threads formed on an outer face of said container wall and internal screw threads formed on an inner face of said outer skirt of said closure so that said closure is releasably engagable with said container.

5. A closure according to claim 4 wherein said internal screw threads are collectively provided by a plurality of circumferentially spaced apart internal screw thread sections.

6. A closure according to claim 4 wherein said external screw threads include two diametrically opposed external screw threads that respectively extend one hundred eighty degrees about said container on opposite sides thereof.

7. A closure for a container, said container having an opening surrounded by a container wall, the closure comprising:

a top wall;

an insert for reception within said opening of the container;

an outer skirt adapted to engage an outer face of said container wall;

said insert and said outer skirt being concentrically disposed with respect to one another, said outer skirt being positioned radially outwardly of said insert, and said insert and outer skirt depending from said top wall;

an annular gap being formed between said insert and said outer skirt;

said insert being resiliently compressible in a radially inwardly direction at its free end;

said insert having a longitudinal extent greater than a longitudinal extent of said outer skirt;

a first seal formed on a free end of said resiliently compressible insert for sealingly engaging an inner face of said container wall;

said first seal engaging said inner face of said container wall prior to full engagement of said outer face of said container wall by said outer skirt;

a second seal disposed in longitudinally spaced apart relationship to said first seal; and an annular channel formed in said outer face of said insert between said first and second seals.

8. A closure according to claim 7, wherein said gap receives a free end of said container wall when said closure is fitted onto said container, and wherein an uppermost end of said gap is specifically configured to seal inner and outer edges of said free end when said closure is fitted onto said container.

9. A closure according to claim 7, further comprising a magnifying means mounted to said outer face of said container wall to facilitate a visual inspection of said first seal.

10. A closure according to claim 9, wherein said magnifying means includes an annular bead.

11. A closure according to claim 7, further comprising an annular bevel formed in the inner face of said container, said annular bevel partitioning said container into an upper part and a lower part and reducing an interior diameter of said lower part of said container relative to said upper part, said annular bevel cooperating with said first seal to effect radial compression of said first seal as the insert progressively enters the opening.

12. A closure according to claim 11, wherein said first seal is bulbous and abuts said bevel when said closure is fully fitted onto said container.

13. A closure according to claim 7, further comprising a plurality of radially disposed strengthening ribs formed integrally with said top wall to strengthen said closure for pressurization and vacuum applications.

14. A closure according to claim 13, wherein said strengthening ribs gradually decrease in height from a center of said top wall to a peripheral edge thereof so that their respective outermost ends are substantially flush with said top wall.

15. A closure according to claim 7, further comprising external screw threads formed on said container and internal screw threads formed on said closure, and wherein said external screw threads include two diametrically opposed external screw threads that respectively extend one hundred eighty degrees about said container on opposite sides thereof.

16. A closure according to claim 15, further comprising an annular concavity formed in said closure about its peripheral edge to weaken said closure so that said outer skirt transiently flexes when said internal screw threads slip over said external screw threads during attachment of said closure to said container.

17. A closure according to claim 15, wherein said external screw threads are rounded on an upper side thereof to enable said internal screw threads to slide thereover when said closure is pushed onto said container.

18. A closure according to claim 17, wherein said external screw threads are flat on a bottom side thereof to prevent said internal screw threads from sliding thereover when an external force is imparted to said closure in an attempt to pull said closure from said container.

* * * * *